US008573721B2

(12) United States Patent
Gordon

(10) Patent No.: US 8,573,721 B2
(45) Date of Patent: Nov. 5, 2013

(54) METHOD OF INCREASING THE LIFE OF A DRUM MAINTENANCE UNIT IN A PRINTER

(75) Inventor: Michael Cameron Gordon, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 127 days.

(21) Appl. No.: 13/226,766

(22) Filed: Sep. 7, 2011

(65) Prior Publication Data

US 2013/0057603 A1 Mar. 7, 2013

(51) Int. Cl.
*B41J 29/38* (2006.01)
*B41J 2/175* (2006.01)

(52) U.S. Cl.
USPC ..... 347/5; 347/88

(58) Field of Classification Search
None
See application file for complete search history.

(56) References Cited

U.S. PATENT DOCUMENTS

| | | | | |
|---|---|---|---|---|
| 6,068,372 | A | 5/2000 | Rousseau et al. | |
| 6,176,575 | B1 * | 1/2001 | Crawford et al. | 347/103 |
| 6,755,519 | B2 | 6/2004 | Gelbart et al. | |
| 7,036,920 | B2 | 5/2006 | Rousseau et al. | |
| 7,677,717 | B2 | 3/2010 | Islam et al. | |
| 8,317,314 | B2 * | 11/2012 | Kohne et al. | 347/103 |
| 2005/0134666 | A1 | 6/2005 | Rousseau | |
| 2007/0139496 | A1 | 6/2007 | Leighton et al. | |
| 2007/0146459 | A1 | 6/2007 | Gault et al. | |
| 2007/0146460 | A1 | 6/2007 | Gordon et al. | |
| 2007/0146461 | A1 | 6/2007 | Islam et al. | |
| 2010/0231674 | A1 | 9/2010 | Domoto et al. | |
| 2010/0271451 | A1 | 10/2010 | Burress et al. | |

* cited by examiner

*Primary Examiner* — Geoffrey Mruk
(74) *Attorney, Agent, or Firm* — Maginot, Moore & Beck, LLP

(57) ABSTRACT

In a method of operating a printer, a release agent application system is operated to conserve release agent. The method of operation rotates the image receiving member that receives the release agent at a slower speed to reduce the amount of release agent applied to the image receiving member at select times. Thus, the release agent supply in the release agent application system lasts longer. For every page that is preceded by this method of image receiving member preparation, image gloss is increased and simplex and duplex image transfer efficiency is improved.

3 Claims, 7 Drawing Sheets

METHOD OF INCREASING THE LIFE OF A DRUM MAINTENANCE UNIT IN A PRINTER

TECHNICAL FIELD

The method described below relates to phase change inkjet printers, and more particularly to release agent application systems used in these printers.

BACKGROUND

Phase change inkjet printers receive phase change ink in a solid form and then melt the solid ink to produce liquid ink that is used to form images on print media. Phase change inkjet printers form images using either a direct or an offset (sometimes called indirect) print process. In a direct print process, melted ink is jetted directly onto print media to form images. In an offset print process, melted ink is jetted onto a surface of a rotating member, such as the surface of a rotating drum, belt, or band. Print media are moved proximate the surface of the rotating member in synchronization with the ink images formed on the surface. The print media are then pressed against the surface of the rotating member as the media passes through a nip formed between the rotating member and a transfix roller. The ink images are transferred and affixed to the print media by the pressure in the nip.

Offset phase change inkjet printers utilize drum maintenance units (DMUs) to facilitate the transfer of ink images to the print media. A DMU is usually equipped with a reservoir that contains a fixed supply of release agent (e.g., silicon oil), and an applicator for delivering the release agent from the reservoir to the surface of the rotating member. One or more elastomeric metering blades are also used to meter the release agent on the transfer surface at a desired thickness and to divert excess release agent and un-transferred ink pixels to a reclaim area of the drum maintenance system. The collected release agent is filtered and returned to the reservoir for reuse.

DMUs are typically provided in a modular form capable of being installed and removed from an imaging device as a self-contained functional unit. The fixed supply of release agent in a DMU provides adequate oil for image transfer for a limited number of prints depending on an average oil usage per print and the quantity of the oil in the reservoir. When the supply of release agent has been depleted, the DMU is removed and replaced with a DMU having a fresh supply of release agent. Replacing DMUs as they are depleted of release agent adds to the operating cost of an imaging device. Finding ways to reduce the amount of oil that is removed from a DMU over time can increase the useful life of the DMU and thus decrease the cost of operating an imaging device.

SUMMARY

A method of operating a printer operates a release agent system to apply release agent in a manner that conserves release agent stored in the release agent system. The method includes rotating an image receiving member of a printer at a first velocity, moving a metering blade of a release agent application system of the printer into engagement with a surface of the image receiving member, moving an applicator of the release agent application system into engagement with the surface of the image receiving member after the metering blade engages the surface of the image receiving member, disengaging the applicator from the surface of the image receiving member after a predetermined distance has been traveled by the rotating image receiving member, increasing rotation of the image receiving member to a second velocity that is greater than the first velocity after the applicator disengages from the surface of the image receiving member and while the metering blade remains in engagement with the surface of the image receiving member, and disengaging the metering blade from the surface of the image receiving member in response to the rotation of the image receiving member reaching the second velocity.

A printer includes a release agent system that operates in a manner that conserves release agent stored in the release agent system. The printer includes a rotatable image receiving member having a surface on which ink images are formed, at least one printhead configured to eject ink onto the surface of the rotatable image receiving member, a release agent application system including: a reservoir containing a supply of release agent, an applicator configured to move into and out of contact with the surface of the rotatable image receiving member to enable the applicator to apply release agent from the reservoir to the surface when the applicator contacts the surface of the image receiving member, and a metering blade configured to move into and out of contact with the surface of the rotatable image receiving member to enable the metering blade to spread the release agent applied to the surface of the rotatable image receiving member. The printer also includes a controller operatively connected to the image receiving member, the applicator, and the metering blade, the controller being configured to rotate the image receiving member and to move the applicator and the metering blade to perform a maintenance cycle during which the controller operates the image receiving member to rotate at a first velocity, the controller operates the metering blade to move into contact with the surface of the rotatable image receiving member and to move the applicator into contact with the surface of the rotatable image receiving member until a predetermined distance has been traveled by the rotating image receiving member at which time the controller moves the applicator out of contact with the surface of the image receiving member, the controller operates the image receiving member to rotate at a second velocity that is greater than the first velocity after the applicator is disengaged from the surface of the rotatable image receiving member and while the metering blade contacts the surface of the rotatable image receiving member, and then operates the metering blade to move out of contact with the surface of the rotatable image receiving member after the rotation of the image receiving member reaches the second velocity.

DETAILED DESCRIPTION

Figure 1:
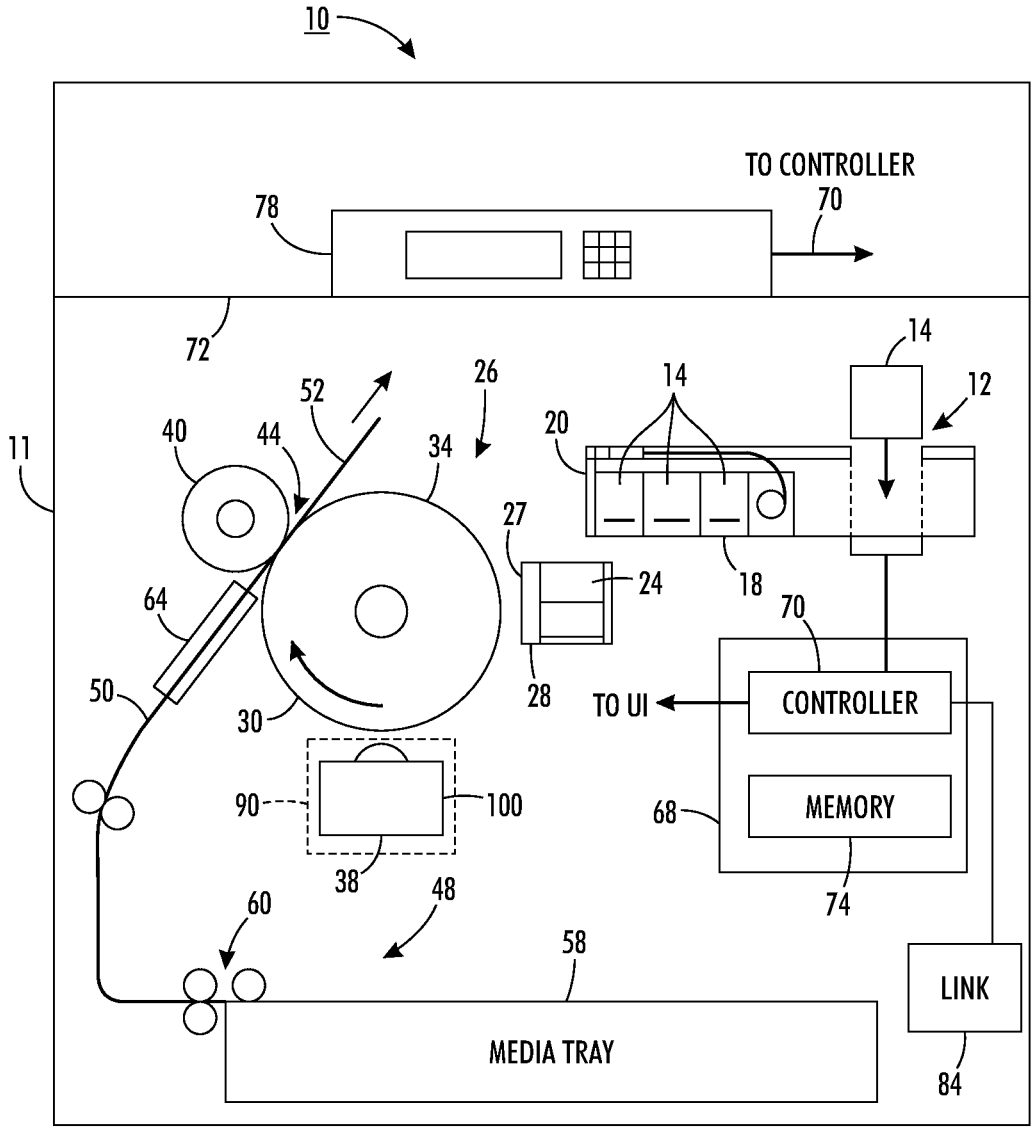
FIG. 1 is a schematic view of an indirect phase change inkjet printing system including a rotatable image receiving member having an image transfer surface.

The description below and the accompanying figures provide a general understanding of the environment for the method disclosed herein as well as the details for the method. In the drawings, like reference numerals are used throughout to designate like elements. The term "printer" as used herein encompasses any apparatus that generates an image on media with ink. As used in this document, "ink" refers to a colorant that is liquid when applied to an image receiving member. For example, ink may be aqueous ink, ink emulsions, melted phase change ink, and gel ink that has been heated to a temperature that enables the ink to be liquid for application or ejection onto an image receiving member and then return to a gelatinous state. The term "printer" includes, but is not limited to, a digital copier, a bookmaking machine, a facsimile machine, a multi-function machine, or the like. The terms "simplex" and "duplex" used in reference to the term "prints" describe whether an ink image is formed on one side of the sheet, i.e., "simplex print," or both sides of the print, i.e., "duplex print." Similarly, as used herein, the "simplex side" or "first side" of a print refers to the side of a print that is positioned to receive an image in a printer. A "print" refers to a substrate of media on which an ink image has been formed.

FIG. 1 is a side schematic view of a phase change inkjet printer 10 configured to form ink images on an image receiving, bearing, or contacting member 34, referred to herein as a drum. The ink image is transferred to a media substrate to form a print. The printer 10 is equipped with a release agent application system 100, also referred to as a drum maintenance unit (DMU), having an applicator for applying release agent, such as silicone oil, to the surface of the drum and a metering blade for spreading the release agent on the surface to a uniform thickness. Excess release agent and un-transferred ink pixels are removed from the drum as the metering blade is applied to the surface of the drum is diverted to a reclaim area of the DMU. The collected release agent is filtered and returned to the reservoir for reuse. The DMU 100 is configured to perform a drum maintenance (DM) cycle for each print produced by the printer 10. As part of a DM cycle, the release agent application system 1) applies and meters release agent on the surface of the drum before each print cycle, and 2) removes and stores any excess oil, ink and debris from the surface of the drum after each print cycle.

As described in this document, a Slow Auto DM cycle has been developed to reduce the amount of oil removed from a DMU during a DM cycle. During a Slow Auto DM cycle, the drum is rotated at a velocity that is reduced relative to a default velocity used during a standard DM cycle. Testing has shown that the amount of release agent deposited onto the surface of an image receiving member, such as drum 30, during a standard DM cycle is directly proportional to the rotational velocity of the drum during metering. By reducing the velocity of the drum, the amount of release agent deposited onto the surface of the drum is decreased. The applicator roller floods the drum with oil during a standard DM cycle and a Slow Auto DM cycle. However, during a slow auto DM cycle, the metering blade is more effective at removing the applied oil from the drum due to the reduced drum velocity during wiping. Therefore, less oil remains on the drum after the metering blade interacts with the drum surface during a slow auto DM. The Slow Auto DM cycle is performed at the conclusion of any print job when no print jobs are in a print job queue. The slow auto DM cycle is also performed if a job in the queue is being ripped by the image processing engine. The Slow Auto DM cycle is also performed when the printer is powered on and when the printer transitions from a standby state to an active printing state. The Slow Auto DM cycle results in less oil being deposited onto the drum for the first page of the next print job entering the print job queue or for the first and the second pages if two pages are formed on the imaging drum during an imaging phase. Because the majority of print jobs generated in a typical office environment are short, e.g., 1-3 pages, the print job queue is frequently empty following execution of a print job. As a consequence, a Slow Auto DM cycle is performed after many print jobs and the decreased oil deposition for the first pages of the following print jobs significantly reduces the amount of oil removed from the DMU over time. Consequently, the supply of release agent is reduced more slowly with the expectation that the life of the DMU is increased.

Although the Slow Auto DM cycle is described below in conjunction with a release agent application system used in a phase change inkjet printer, a Slow Auto DM cycle can be used with the release agent or lubricant application systems of other printers. For example, a Slow Auto DM cycle can be used with a release agent application system that operates on a fuser roll in a xerographic printer or on an ink spreader in a phase change ink printer that prints directly on media.

FIG. 1 depicts the relationship between the DMU 100 and the other components of the exemplary phase change inkjet printer 10. The printer 10 includes a housing 11 that supports and at least partially encloses an ink loader 12, an image forming system 26, a media supply and handling system 48, and a control system 68. The ink loader 12 receives and delivers solid ink units 14 to a melting device 20 for generation of liquid ink. The image forming system 26 includes at least one printhead 28 having a plurality of inkjets that is fluidly connected to a reservoir holding melted ink to receive the ink melted by the melting device 20. Control system 68 operates the inkjets in the printhead 28 to eject drops of liquid ink onto the image transfer surface 30. The media supply and handling system 48 extracts media sheets from one or more media trays 58 in the printer 10, synchronizes delivery of the media sheets to a transfix nip 44 for the transfer of an ink image from the image receiving surface 30 to the media sheets as they pass through the nip, and then delivers the prints to an output area.

Control system 68 aids in operation and control of the various subsystems, components, and functions of the printer 10. The control system 68 is operatively connected to one or more image data sources, such as a scanner, to receive and manage image data from the sources. The control system 68 also generates control signals that are delivered to the components and subsystems of the printer. Some of the control signals, such as firing signals for the printhead, are based on image data, while other control signals regulate the operating speeds, power levels, timing, actuation, and other parameters, of the printer components to cause the printer 10 to operate in various states, modes, or levels of operation, referred to collectively herein as operating modes. These operating modes include, for example, a startup or warm up mode, shutdown mode, various print modes, maintenance modes, and power saving modes.

The control system 68 is configured to ascertain relevant print job characteristics and attributes in a suitable manner, such as by parsing information in image data files or by monitoring the components and sensors of the printer. The print characteristics and attributes obtained by the control system include print media type, print size, fill or coverage level (i.e., percent of the print covered with ink), and whether the print is a simplex (image on one side) or a duplex (image on both sides) print.

The control system 68 includes a controller 70 and electronic storage or memory 74. The controller 70 has a processor, such as a central processing unit (CPU), an application specific integrated circuit (ASIC), a field programmable gate array (FPGA) device, or a micro-controller. Among other tasks, the processor executes programmed instructions that are stored in the memory 74. The controller 70 executes these instructions to operate the components and subsystems of the printer. Any suitable type of memory or electronic storage may be used. For example, the memory 74 may be a non-volatile memory, such as read only memory (ROM), or a programmable non-volatile memory, such as EEPROM or flash memory.

The controller 70 is operatively connected to a user interface (UI) 78. User interface (UI) 78 comprises a suitable input/output device positioned on the printer 10 to enable operator interaction with the control system 68. For example, UI 78 may include a keypad and display (not shown). The controller 70 is operatively connected to the user interface 78 to receive signals indicative of selections and other information input to the user interface 78 by a user or operator of the device. Controller 70 is also operatively connected to the user interface 78 to display information to a user or operator including selectable options, machine status, consumable status, and the like. The controller 70 is operatively connected to a communication link 84, such as a computer communication network, for receiving image data files and user interaction data from remote locations.

The ink loader 12 of the printer 10 is configured to receive phase change ink in solid form, such as blocks of ink 14, which are commonly called ink sticks. The ink loader 12 includes feed channels 18 into which ink sticks 14 are inserted. Although a single feed channel 18 is visible in FIG. 1, the ink loader 12 includes a separate feed channel for each color or shade of color of ink stick 14 used in the printer 10. The feed channel 18 guides ink sticks 14 toward the melting device 20 at one end of the channel 18 where the sticks are heated to a phase change ink melting temperature to melt the solid ink and form liquid ink. Any suitable melting temperature may be used depending on the phase change ink formulation. In one embodiment, the phase change ink melting temperature is in a range of approximately 80° C. to approximately 130° C. In some embodiments, alternative ink loader configurations, ink forms, and ink formulations are used.

The melted ink from the melting assembly 20 is directed gravitationally or by actuated systems, such as pumps, to a melt reservoir 24. A separate melt reservoir 24 may be provided for each ink color, shade, or composition used in the printer 10. Alternatively, a single reservoir housing may be compartmentalized to contain the differently colored inks. As depicted in FIG. 1, the ink reservoir 24 comprises a printhead reservoir that supplies melted ink to inkjet ejectors 27 formed in the printhead(s) 28. The ink reservoir 24 may be integrated into the printhead 28. In alternative embodiments, the reservoir 24 is a separate or independent unit from the printhead 28. Each melt reservoir 24 may include a heating element (not shown) operable to heat the ink contained in the corresponding reservoir to a temperature suitable for melting the ink and/or maintaining the ink in liquid or molten form, at least during appropriate operational states of the printer 10.

The image forming system 26 includes at least one printhead 28. One printhead 28 is shown in FIG. 1 although any suitable number of printheads 28 may be used. The inkjets 27 of the printhead 28 are operated with firing signals generated by the control system 68 to eject drops of ink toward the image receiving surface 30. The printer 10 of FIG. 1 is an indirect printer configured to use an indirect printing process in which the drops of ink are ejected onto the intermediate transfer surface 30 and then transferred to media sheets. In alternative embodiments, the printer 10 is configured to eject the drops of ink directly onto media, which may be in sheet or continuous web form.

The image receiving member 34 is shown as a drum in FIG. 1, although in alternative embodiments the image receiving member 34 is a moving or rotating belt, band, roller or other similar type of structure. A transfix roller 40 is configured for movement into and out of engagement with the image receiving member. The control system 68 selectively operates an actuator (not shown) to implement this movement. The transfix roller 40 is loaded against the transfer surface 30 of the image receiving member 34 to form a nip 44 through which sheets of print media 52 pass. The sheets are fed through the nip 44 in timed registration with an ink image formed on the transfer surface 30 by the printhead 28. Pressure (and in some embodiments heat) is generated in the nip 44 to facilitate the transfer of the ink drops from the surface 30 to the print media 52 in conjunction with release agent to substantially prevent the ink from adhering to the image receiving member 34.

The image receiving member 34 includes an actuator 144 (FIGS. 2 and 3) that drives the image receiving member to rotate at various predetermined velocities in response to control signals received from the control system 68. The various velocities include an imaging velocity and a transfixing velocity. The control system 68 is configured to cause the image receiving member 34 to rotate at the imaging velocity during imaging operations, i.e., when the ink images are formed on the transfer surface, and to cause the image receiving member 34 to rotate at the transfixing velocity during transfixing operations, i.e., when the print media are fed through the nip 44 in timed registration with the ink images formed on the transfer surface 30. The imaging and transfixing velocities may be different for different print jobs depending upon the characteristics of the print job, such as print job type, media type, job size, resolution, and coverage level, as well as drum surface condition, pixel transfer efficiency, image durability, properties of the oil, metering blade geometry, and desired oil film thickness. In one embodiment, the imaging velocity and the transfixing velocity are each between approximately 1200 mm/s and 2000 mm/s although any suitable velocity or range of velocities may be used for one or both of the imaging and transfixing velocities.

The normal, or default, velocity of the image receiving member, or drum, during a standard DM cycle is typically dictated by the imaging and transfixing speed requirements for the current print. For example, the drum velocity at the beginning of a DM cycle at which time the metering blade typically is moved into engagement with the image receiving member, usually corresponds to the imaging velocity for the image currently being printed, while the drum velocity at the end of the DM cycle at which time the metering blade typically is moved out of engagement with the image receiving member, usually corresponds to the transfixing velocity for the ink image being transferred to media. These values are chosen to maximize print speed and minimize image quality defects. As explained below, the control system is also configured to actuate the image receiving member to rotate at a predetermined reduced velocity during a Slow Auto DM cycle. In one embodiment, the reduced velocity for the Slow Auto DM cycle is approximately 200-500 mm/s, and, in one particular embodiment, is 254 mm/s.

Referring to FIG. 1, the media supply and handling system 48 of printer 10 transports print media along a media path 50 that passes through the nip 44. The media supply and handling system 48 includes at least one print media source, such as supply tray 58. The media supply and handling system also includes suitable mechanisms, such as rollers 60, which may be driven rollers or idle rollers, as well as baffles, deflectors, and the like, for transporting media along the media path 50.

Media conditioning devices may be positioned at various locations along the media path 50 to prepare the print media thermally to receive melted phase change ink. In the embodiment of FIG. 1, a preheating assembly 64 is utilized to bring print media on media path 50 to an initial predetermined temperature prior to reaching the nip 44. Media conditioning devices, such as the preheating assembly 64, may rely on radiant, conductive, or convective heat or any combination of these heat forms to bring the media to a target preheat temperature, which in one practical embodiment, is in a range of about 30° C. to about 70° C. In alternative embodiments, other thermal conditioning devices may be used along the media path before, during, and after ink has been deposited onto the media.

Figure 2:
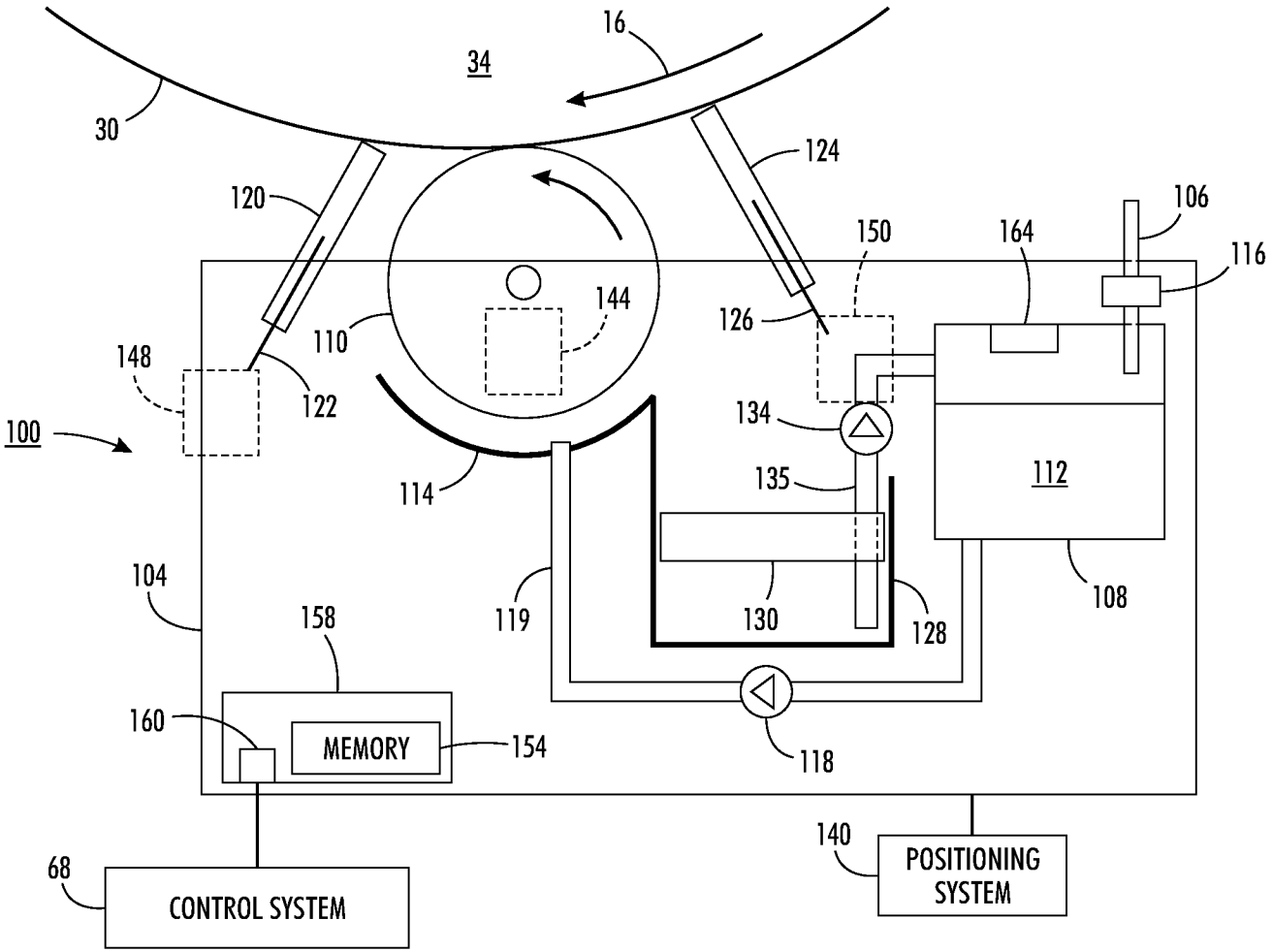
FIG. 2 is a schematic view of drum maintenance system of the printing system of FIG. 1 in an engaged position with respect to the image transfer surface.
Figure 3:
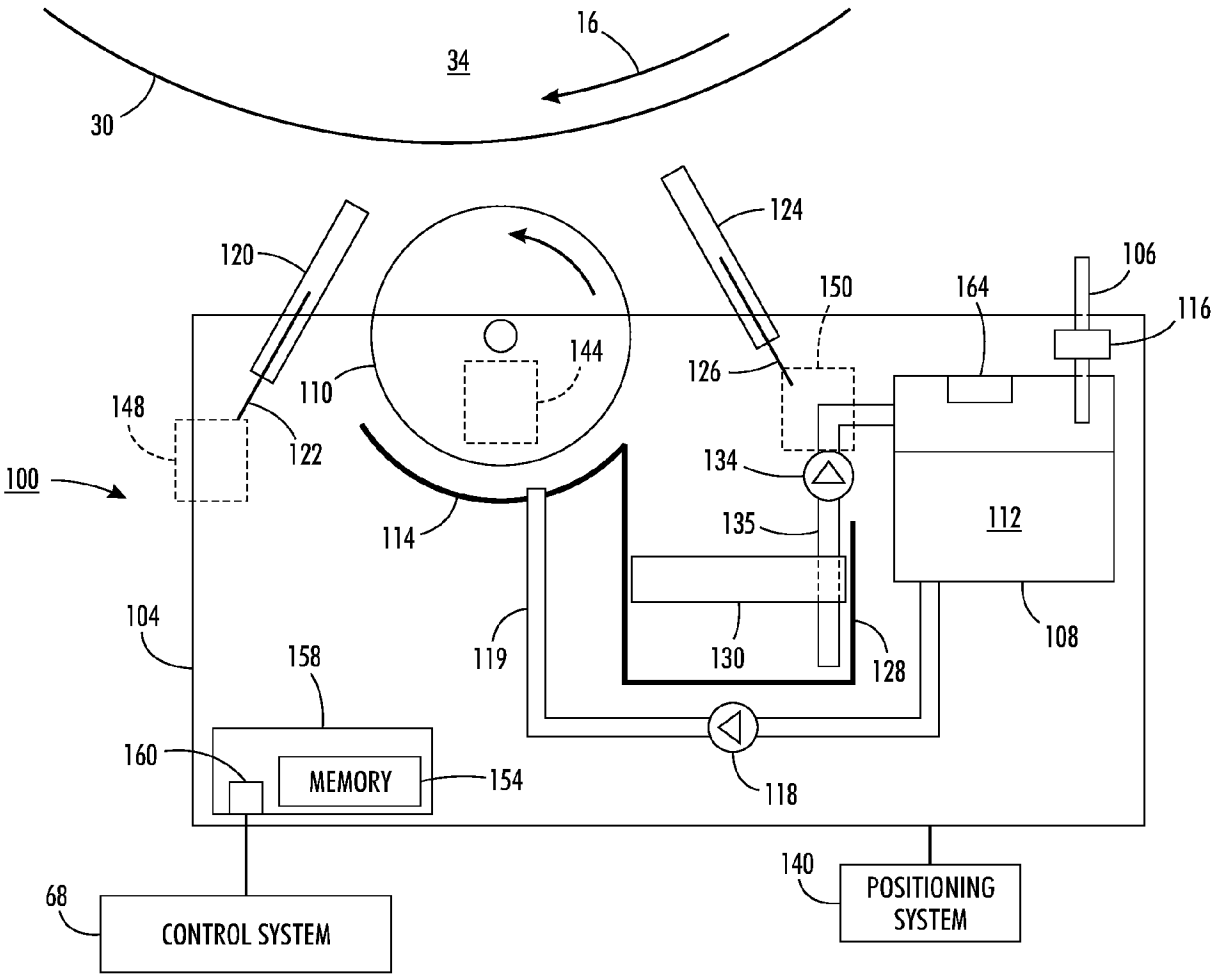
FIG. 3 is a schematic view of the drum maintenance system of FIG. 2 in a disengaged position with respect to the image transfer surface.

The release agent application system 100, referred to above as a drum maintenance unit (DMU), applies release agent to the surface 30 of the image receiving member 34. Referring to FIGS. 2 and 3, the DMU 100 includes a housing 104, a reservoir 108, an applicator 110, a reclaim area 114, a pump 118, a metering blade 120, a cleaning blade 124, a sump 128, a filter 130, a sump pump 134, a positioning system 140, and a memory 154. In some embodiments, the DMU varies in some aspects from the one described and shown in the accompanying figures. For example, in some embodiments, the metering blade is also used as the cleaning blade.

The DMU housing 104 is formed of a material, such as molded plastic, that is compatible with the release agent used in the printer 10 and that is capable of withstanding the environment within the housing 11 of the printer 10 during operational use of the printer. The reservoir 108 is positioned within the housing and is configured to hold a supply of release agent 112. A vent tube or conduit 106 fluidly connects the interior of the reservoir 108 to atmosphere to relieve any positive or negative pressure developed in the reservoir. The vent tube includes a solenoid valve 116 that is normally closed to prevent any oil leaks during shipping and customer handling. The solenoid valve 116 is opened as oil is being pumped into and out of the oil reservoir to allow the reservoir to vent to atmospheric pressure.

In some embodiments, the reservoir 108 is equipped with a pressure sensor 164, such as a pressure transducer, which is configured to directly or indirectly detect or measure the pressure in reservoir 108. As discussed below, the pressure sensor 164 may be used after a maintenance cycle is performed to determine a change in pressure in the reservoir as a result of pumping release agent to or from the reservoir. The change in pressure may then be used to determine a time period during which the solenoid valve 106 remains open after pumping has been completed to return the pressure to ambient.

The applicator 110 is configured to apply the release agent 112 to the transfer surface 30 after the release agent is pumped from the reservoir 108 by the pump 118. In the embodiment of FIG. 2, the applicator 110 comprises a roller formed of an absorbent material, such as extruded polyurethane foam. In other embodiments, the applicator 110 is provided in a number of other shapes, forms, and/or materials. Each of these variations enable release agent from the reservoir 108 to be supplied to the reclaim area 114 where the applicator 110 absorbs the release agent and applies it to the surface 30. For example, in other embodiments, the applicator 110 is comprised of a blotter or pad formed of an absorbent low-friction material that is pressed against the transfer surface 30 to apply release agent.

To facilitate saturation of the roller 110 with the release agent, the roller 110 is positioned over a reclaim area 114 in the form of a tub or trough, referred to herein as a reclaim trough. A pump 118 moves release agent from the reservoir through a conduit 119, or other suitable flow path, to the reclaim trough 114. In one embodiment, the pump 118 comprises a peristaltic pump, although any suitable type of fluid pump or fluid transport system may be used.

In the embodiment of FIG. 2, the reclaim trough 114 has a bottom surface that follows the cylindrical profile of the lower portion of the roller 110. The roller 110 is positioned with respect to the reclaim trough 114 to partially submerge the roller in release agent. In some embodiments, the bottom surface of the trough includes surface features (not shown), such as chevrons, that protrude from the surface and are shaped or angled to direct oil from the outer edges of the roller toward the center.

The metering blade 120 is positioned close to the drum 34 and is configured to move into and out of contact with the surface 30 of the drum 34. When the blade 120 contacts the surface 30, the angle of attack of the blade enables the blade to spread the release agent applied to the surface 30 by the roller 110 to a uniform thickness. The metering blade 120 may be formed of an elastomeric material, such as urethane, supported on an elongated metal support bracket 122. The metering blade 120 helps ensure that a uniform thickness of the release agent is present across the width of the surface 30. In addition, the metering blade 120 is positioned above the reclaim trough 114 to divert excess oil metered from the surface 30 by blade 120 back into the reclaim trough 114.

The DMU 100 also includes a cleaning blade 124 that is positioned close to the drum 34 and is configured to move into and out of contact with the surface 30 of the drum 34. When the blade 124 contacts the surface 30 of the drum 34, the angle of attack of the blade enables the blade to scrape release agent and debris, such as paper fibers, residual ink and the like, from the surface 30 prior to a fresh application of release agent by roller 110. In particular, after an ink image is fixed onto a print media, the portion of the drum upon which the image was formed is contacted by the cleaning blade 124. Similar to the metering blade 120, the cleaning blade 124 may be formed of an elastomeric material, such as urethane, supported on an elongated metal support bracket 126. The cleaning blade 124 is positioned above the sump 128 to enable oil and debris scraped off of the surface 30 to be directed to the sump 128.

The sump 128 comprises a receptacle or compartment positioned to capture excess release agent delivered to the reclaim trough 114, as well as release agent, dust, dried ink, and other debris diverted from the transfer surface 30. The sump 128 is fluidly connected to the reservoir 108 by a conduit 135. The sump pump 134 is configured to move release agent from the sump 128 through the conduit 135 to the reservoir 108. A filter 130 is positioned in the conduit 135 to clean ink, oil, and debris that must pass through the filter before entering the reservoir 108. In one embodiment, the sump pump 134 comprises a peristaltic pump although any suitable device may be used that moves release agent to be pumped to the reservoir from the sump 128.

In the embodiment of FIGS. 1 and 2, the DMU 100 is implemented as a customer replaceable unit (CRU). As used herein, a CRU is a self-contained, modular unit that enables all or most of the components of the CRU to be inserted into and removed from a printer as a single unit. When implemented as a CRU, the components of the DMU, such as the housing 104, reservoir 108, release agent supply 112, applicator 110, and blades 120, 124 are configured in a modular form capable of being inserted into and removed from the housing 11 of the printer 10 as single component. As depicted in FIG. 1, the printer 10 includes a docking space or area 90 (shown schematically as a dotted line in FIG. 1) in the housing 11 that is configured to receive the DMU 100. The printer 10 and/or the DMU housing 104 is provided with suitable attachment features (not shown), such as fastening mechanisms, latches, positioning guide features, and the like, to enable the correct placement and installation of the DMU 100 within the housing 11. In other embodiments, the DMU may be a single field replaceable unit (FRU) or a collection of FRUs.

As a CRU, the DMU 100 has an expected lifetime, or useful life, that corresponds to the amount of oil loaded in the DMU reservoir 108. In the exemplary embodiment, the useful life may be between approximately 300,000 and 500,000 prints depending on factors such as oil usage and the amount of oil in the reservoir. When the DMU has reached the end of its useful life, for example, when the unit is out of release agent, the DMU may be removed from its location or slot in the imaging device and replaced with a new DMU.

The DMU 100 includes a positioning system 140 (FIG. 2) that enables the applicator 110, metering blade 120, and cleaning blade 124 to be selectively moved into and out of engagement with the surface 30 once the DMU is inserted into the housing. For example, the positioning system in one embodiment includes a moveable member that interacts with a cam in the housing 11 of the printing printer 10. In the embodiment of FIG. 2, the positioning system 140 includes a separate positioning mechanism 144, 148, and 150, such as a cam follower, for each of the applicator 110, metering blade 120, and cleaning blade 124, respectively. Each positioning system enables the component operatively connected to the positioning system to be moved into and out of engagement with the transfer surface 30 independently. The positioning mechanisms of the positioning system are configured to enable the applicator 110, metering blade 120, and cleaning blade 124 to be selectively and independently moved between a disengaged position (FIG. 3) spaced apart from the surface 30 and an engaged position (FIG. 2) in contact with the transfer surface 30. In an alternative embodiment, the positioning mechanism 140 is configured so the DMU is moved between an engaged position and a disengaged position with respect to the transfer surface as a unit.

Referring again to FIG. 2, the DMU 100 includes a memory device 154, such as an EEPROM, for storing operational values and other information pertaining to the DMU 100, including data and operational information pertaining to the gel-based life-sensing process for use by the control system. The memory includes a plurality of memory locations for storing information pertaining to the operation of the DMU, such as the initial mass of release agent stored in the reservoir, the estimated current mass of release agent in the reservoir, the total number of prints performed by the DMU, the number of prints that are simplex prints, the number of prints that are duplex, the total media area of the prints, and the total media area that has been covered with ink.

In one embodiment, the memory 154 is installed on a circuit board 158. The circuit board 158 includes a suitable connector 160 configured to electrically connect the circuit board 158 including memory 154 to the printer control system 68 when the DMU 100 is installed in the housing 11. Once the DMU 100 is inserted into the printer 10 and the memory 154 is connected to the controller 70, the control system 68 selectively accesses the memory 154 to retrieve the operational values and selectively write operational values to the memory 154 to update the values during use. In this manner, DMU performance and life expectancy are tracked. In addition, various controllable components of the DMU 100, such as the solenoid valve 116, delivery pump 118, sump pump 134, pressure sensor 164, and the positioning mechanisms 144, 148, and 150 of the positioning system 140 are each operatively connected to the circuit board 158 so the control system 68 can operate these components.

Figure 4:
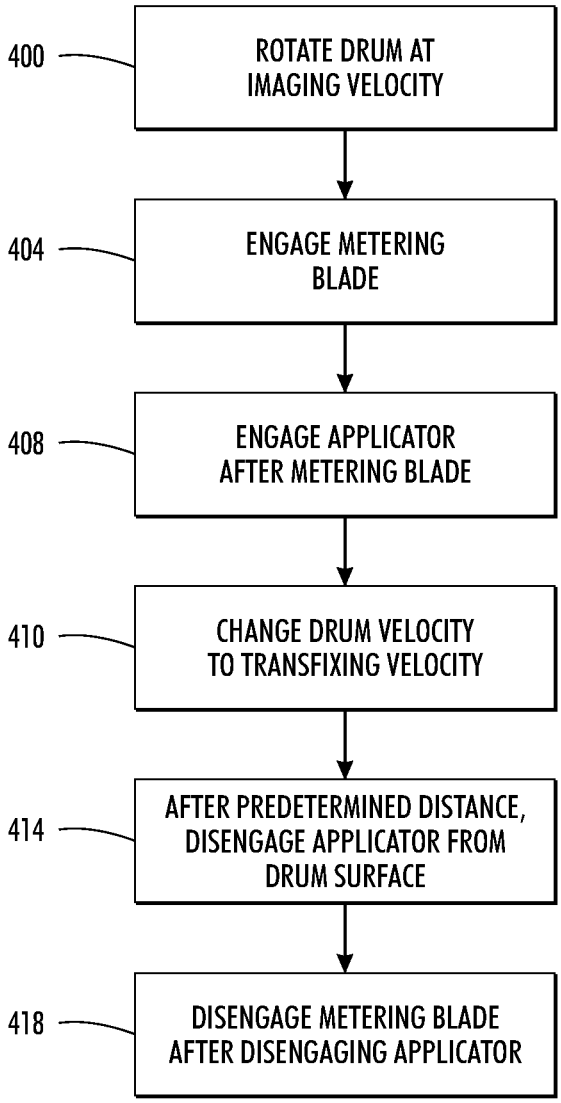
FIG. 4 is a flowchart depicting a standard DM cycle.

The control system operates the DMU to perform a DM cycle for each page of each print job performed by the printer 10. A standard, or full speed, DM cycle is performed for most pages of a print job. Typically, priority is placed on print speed; therefore, a DM cycle is nested within the print process to minimize overhead, for example, non-imaging and transfixing time, and maximize print speed. Although the DM system is optimized to reduce oil consumption at full print speed, oil consumption can be further reduced when the DM cycle is decoupled from the printing process. This is achieved using the slow auto DM cycle. A flowchart depicting a simplified version of a standard DM cycle is illustrated in FIG. 4. During a standard DM cycle, the drum is rotated at a first velocity during ink image formation, which in one embodiment is approximately 1200-2000 mm/s (block 400). As the drum is rotated at the first velocity, the control system operates the positioning system 140 to actuate the positioning mechanism 148 to move the metering blade 120 into engagement with the surface of the drum (block 404). Similarly, the control system operates the positioning system 140 to actuate the positioning mechanism 144 to move the applicator into contact with the surface 30 to apply release agent to the drum surface (block 408). The metering blade and applicator remain in engagement with the drum surface for a predetermined distance. The velocity of drum rotation is changed from the first velocity to a velocity useful for transfixing the ink image onto a media sheet (block 410). After the predetermined distance, the control system operates the positioning system 140 and positioning mechanisms 148 and 144 to disengage the applicator from the surface of the drum (block 414). After a second predetermined distance, the metering blade is disengaged from the surface of the drum (block 418). The predetermined distance for the applicator engagement is selected with reference to the circumference of the drum. The predetermined distance for engagement of the metering blade is typically equal to or longer than the predetermined engagement distance for the applicator. The maximum metering blade wiping distance is typically chosen so that it does not slow down printing.

Figure 5A:
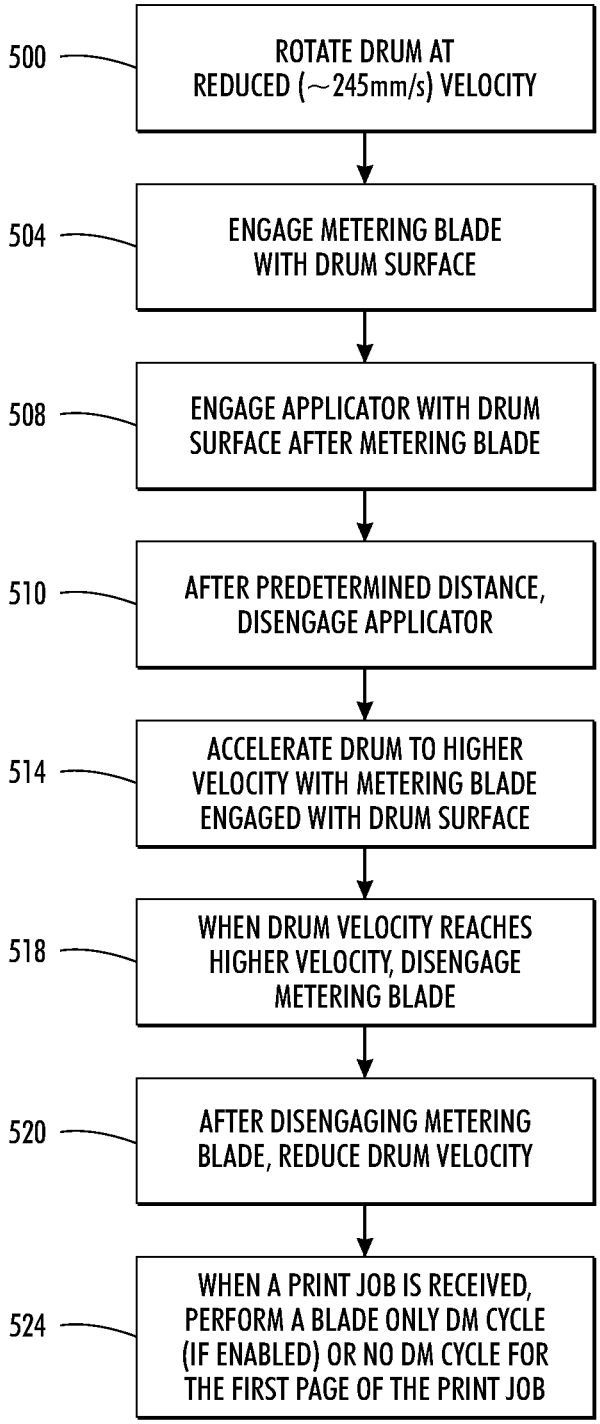
FIG. 5A is a flowchart depicting a Slow Auto DM cycle.
Figure 5B:
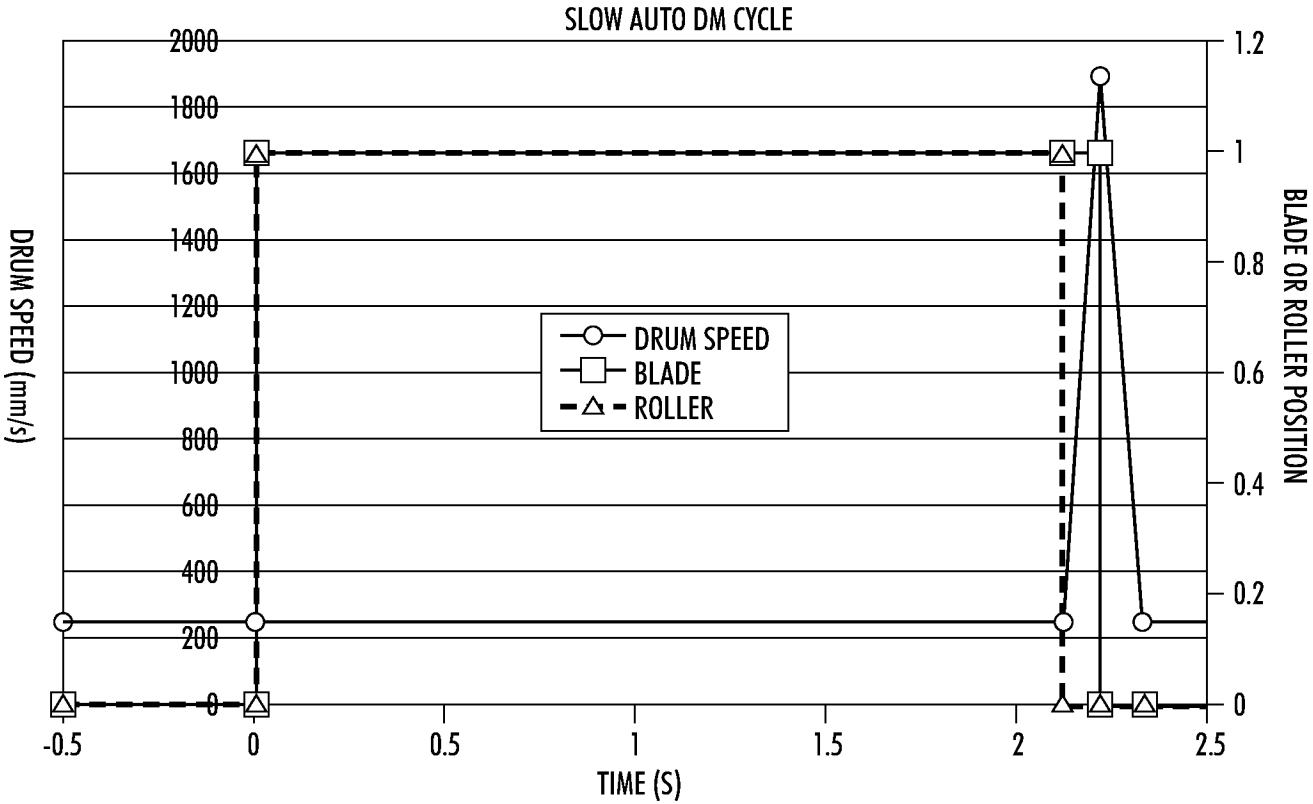
FIG. 5B is a graph depicting the timing sequence of the Slow Auto DM cycle of FIG. 5A.

To reduce the amount of release agent that is removed from the DMU over time, the control system 68 of the printer 10 is configured to operate the DMU and the drum with a Slow Auto DM cycle. A flowchart depicting a Slow Auto DM cycle is depicted in FIG. 5A. In a Slow Auto DM cycle, the drum is rotated at a velocity that is less than the first (imaging) velocity and transfixing velocity (block 500). A graph showing the timing sequence for the Slow Auto DM cycle is depicted in FIG. 5B. In one embodiment, the reduced drum velocity is approximately 200-500 mm/s. With the drum rotating at the reduced velocity, the control system operates the positioning system 140 and the positioning mechanism 144 to move the metering blade into engagement with the surface of the drum (block 504). The control system also operates the positioning system 140 and the positioning mechanism 148 to move the applicator in contact with the drum (block 508). The metering blade and applicator remain in engagement with the surface of the drum for a predetermined distance that corresponds to approximately one full revolution of the drum. After the predetermined distance has been traveled, the control system operates the positioning system to disengage the applicator from the drum surface (block 510) while the metering blade remains in contact with the drum surface. Immediately after the applicator is moved away from the drum surface, the drum is accelerated to a higher drum velocity with only the blade engaged with the drum (block 514). In one embodiment, the higher drum velocity corresponds substantially to one or both of the first and transfixing velocities, e.g., approximately 1200-2000 mm/s. When the drum reaches the higher drum velocity, the metering blade is disengaged from the drum surface (block 518). Disengaging the metering blade after the drum velocity reaches the higher velocity helps reduce any oil bar that may form after the metering blade lifts away from the drum surface. After the metering blade is disengaged, the velocity of the drum is reduced from the higher velocity to the reduced drum velocity used at the initiation of the Slow Auto DM cycle, e.g., the 200-300 mm/s (block 520). In some embodiments, the final drum velocity is reduced to zero or to a velocity conducive to maintaining a uniform drum temperature gradient while the printer waits for the next print job. Thereafter, when the next print job is received after performing the Slow Auto DM cycle, the control system may optionally operate the DMU and drum to perform a non-standard DM cycle in which only the metering blade engages the image receiving member or no DM cycle is performed for the first page of the print job (block 524). The optional blade only DM cycle enables the next print to begin imaging as fast as possible. If the next image cannot be placed over the release agent smear, a blade only DM cycle preceding the next image speeds up the first page out since the drum does not need to move to a position to avoid the oil smear.

A Slow Auto DM cycle is performed following the completion of each print job not having any other fully ripped print jobs following in the print job queue. A Slow Auto DM cycle may also be performed when the printer 10 is started from a powered down state or when the device transitions to a ready state from a standby state or suspended operations state. Once the Slow Auto DM cycle has been performed, a print cycle in which no DM cycle is performed may begin as soon as a print job is received in the print job queue. In one embodiment, after a Slow Auto DM cycle has been performed, a print cycle is performed without a DM cycle once a print job is received. In this embodiment, the amount of time required to generate the first page of these print jobs is reduced because no DM cycle is performed. In addition, the first print of a print job may be generated with less noise because the sound generated by release agent application and metering is avoided. In another embodiment, after a Slow Auto DM cycle has been performed, a DM cycle in which only the metering blade engages the image receiving member is performed for the first print cycle of the next print job received in the print job queue. During this blade only DM cycle, the control system operates the positioning system to move the metering blade into engagement with the surface of the drum without operating the positioning system to move the applicator into engagement with the drum surface. In either case, after a Slow Auto DM cycle has been performed, release agent is not deposited onto the surface of the drum for the first page of a next print job received when the printer 10 is in an idle state, also referred to as the first page out (FPO). The absence of an applicator operation results in lower release agent consumption by the first page of the print job or the first and second page of a print job if two ink images are printed at a time on the drum. Because most print jobs have a low number of pages, e.g., 1-3, this reduction in release agent consumption for the first pages of some print jobs can significantly reduce overall release agent consumption and thus increase the life of the release agent supply, and, consequently, the DMU. Testing has shown that the slow auto DM cycle reduces oil consumption of a solid fill page by approximately 40%. Simplex image transfer efficiency, also known as pixel drop out, duplex image transfer efficiency, and image gloss are all significantly reduced for pages that are preceded by the slow auto DM cycle.

Figure 6:
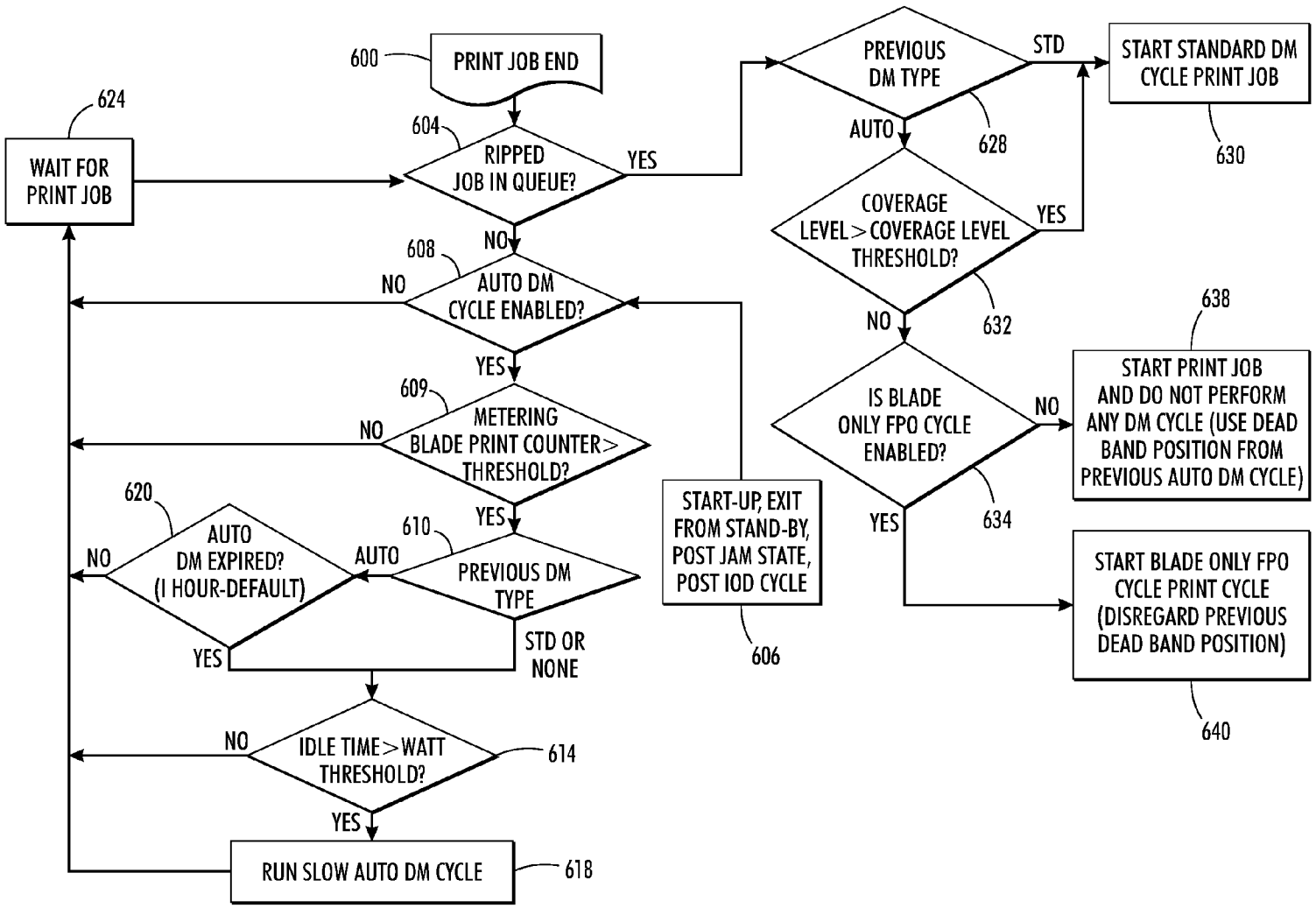
FIG. 6 is a flowchart depicting a print process that incorporates the Slow Auto DM cycle of FIG. 5.

A flowchart of a print process that incorporates the Slow Auto DM cycle is shown in FIG. 6. As depicted, at the end of each print job (block 600), the printer queue is checked to detect whether any print jobs are waiting to be performed (block 604). If no fully ripped print job is in the job queue, a check is made to determine whether the Slow Auto DM cycle is enabled (block 608). A similar check is made when the device is being started from a powered down state or when the device is transitioning to a ready state from a standby state or suspended operations state (block 606). When the Slow Auto DM cycle is enabled, a further check is made to determine whether the previous DM cycle was a standard DM cycle or a Slow Auto DM cycle (block 610). In one embodiment, when the previous DM cycle was a standard DM cycle or no DM cycle was performed, the Slow Auto DM cycle is performed only after the device is in an idle state for a predetermined time period. The control system is configured to monitor the idle time of the imaging device. The idle time refers to the time elapsed from the end of the previous print job while no jobs are waiting in the queue. The idle time is compared to a predetermined idle time, or wait, threshold value (block 614). If the idle time is greater than the wait threshold value, a Slow Auto DM cycle is performed (block 618). In one embodiment, the threshold value is one second.

If the printer 10 remains in an idle state for a prolonged duration after a Slow Auto DM cycle has been performed prior to receiving a print job, another Slow Auto DM cycle may be performed. For example, in one embodiment, if the previous DM cycle was a Slow Auto DM cycle, the control system 68 determines whether an elapsed time since the previous Slow Auto DM cycle has exceeded a predetermined threshold (block 620). That is, the control system 68 monitors the amount of time that has elapsed since the Slow Auto DM cycle was performed and compares the elapsed time to a predetermined threshold time value. If the elapsed time is greater than the threshold value, a Slow Auto DM cycle is performed (block 618). The predetermined threshold time value may be any suitable value and, in one embodiment, is set to infinity and, in another embodiment, the predetermined threshold time value is approximately 1 hour. If the elapsed time since the previous Slow Auto DM cycle does not exceed the threshold value, a Slow Auto DM cycle is not performed and the control system waits for the next print job to be received in the queue (block 624). This time threshold value helps avoid issues, such as transfer efficiency reduction, caused by oil evaporation or debris build-up on the drum surface.

When a ripped print job is detected in the queue, the control system checks to determine whether the last performed DM cycle was a standard DM cycle or a Slow Auto DM cycle (block 628). If the previous DM cycle was a standard DM cycle, a standard DM cycle is performed for the detected print job (block 630). If the previous DM cycle was a Slow Auto DM cycle, the control system determines whether a blade only DM cycle has been enabled (block 634). If the blade only DM cycle is not enabled, a print cycle is performed that does not include a DM cycle (block 638). If a blade only DM cycle is enabled, a print cycle is performed with a blade only DM cycle (block 640). Control then returns to block 600.

For certain types of images, the lower release agent deposition for the slow auto DM cycle may not be adequate for ink image transfer and results in paper path smudging. For example, ink images that have a high coverage level typically have more ink pixels to transfer to print media than images with low coverage, and therefore may have an increased risk of smudging as the media moves along the media path. To reduce the risk of these types of defects, the control system 68 is configured to perform a standard DM cycle rather than a Slow Auto DM cycle based on the coverage level and/or image composition of the image to be printed. As mentioned above, the control system 68 is configured to parse image data to determine relevant print characteristics including the coverage level. In one embodiment, if the previously performed DM cycle was a Slow Auto DM cycle, the control system 68 is configured to compare the coverage level of a next print in a print job to a predetermined coverage level threshold value (block 632). If the coverage level of the print is greater than the coverage level threshold value, a standard DM cycle is performed for the print regardless of whether a previous Slow Auto DM cycle has been performed. In one embodiment, the coverage level threshold value is set to infinity.

In addition to the speed of the drum, the amount of release agent that is deposited onto the drum during a DM cycle is also a function of metering blade wear. As wear of the blade increases, the amount of release agent that is metered onto the drum by the blade increases. For example, a metering blade may initially meter release agent onto the surface of the drum at approximately 3-4 mg/print. In some embodiments, this amount increases to approximately 8-9 mg/print after 50,000-100,000 prints have been performed. Therefore, very new metering blades sometimes provide too little oil during a slow auto DM cycle and image smudge defects may occur. Accordingly, in some embodiments the control system 68 is configured to begin utilizing the Slow Auto DM cycle after the metering blade has been used for a predetermined number of release agent applications. In one embodiment, the control system 68 maintains a count of the number of prints executed by the metering blade of the DMU and enables the Slow Auto DM cycle in response to the count reaching a predetermined print count value (block 609). The predetermined print count value may be any suitable number of prints. In one embodiment, the control system 68 is configured to enable the Slow Auto DM cycle after the release agent application system has been used to apply release agent for 20,000 prints.

It will be appreciated that variations of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A printer comprising:

a rotatable image receiving member having a surface on which ink images are formed;

at least one printhead configured to eject ink onto the surface of the rotatable image receiving member;

a release agent application system including:

a reservoir containing a supply of release agent;

an applicator configured to move into and out of contact with the surface of the rotatable image receiving member to enable the applicator to apply release agent from the reservoir to the surface when the applicator contacts the surface of the image receiving member; and a metering blade configured to move into and out of contact with the surface of the rotatable image receiving member to enable the metering blade to spread the release agent applied to the surface of the rotatable image receiving member;

a controller operatively connected to the image receiving member, the applicator, and the metering blade, the controller being configured to perform a maintenance operation in response to the printer entering an idle state by operating the release agent application system to:

rotate the image receiving member at a first velocity;

move the metering blade into contact with the surface of the rotatable image receiving member and to move the applicator into contact with the surface of the rotatable image receiving member until a predetermined distance has been traveled by the rotating image receiving member at which time the controller moves the applicator out of contact with the surface of the image receiving member;

rotate the image receiving member at a second velocity that is greater than the first velocity after the applicator is disengaged from the surface of the rotatable image receiving member and while the metering blade contacts the surface of the rotatable image receiving member, move the metering blade out of contact with the surface of the rotatable image receiving member after the rotation of the image receiving member reaches the second velocity;

prepare the surface of the rotatable image receiving member for a first page of a first print job with a blade only maintenance cycle by rotating the image receiving member at a third velocity that is greater than the first velocity, move the metering blade into engagement with the surface of the rotatable image receiving member while maintaining the applicator out of contact with the surface of the rotatable image receiving member, and move the metering blade out of contact with the surface of the rotatable image receiving member after a predetermined distance has been traveled by the rotatable image receiving member.

2. The printer of claim 1, the controller being further configured to operate the printer to:

eject ink onto the surface of the rotatable image receiving member without applying release agent to the surface of the rotatable image receiving member for the first page of the first print job in response to a blade only maintenance cycle being disabled.

3. The device of claim 2, the controller being further configured to operate the release agent application system to perform a standard maintenance cycle for each page of the first print job after the first page, the controller being configured to perform the standard maintenance cycle by operating the release agent application system to:

rotate the image receiving member at the third velocity, move the metering blade into contact with the surface of the rotatable image receiving member, move the applicator into contact with the surface of the rotatable image receiving member after the metering blade contacts the surface of the rotatable image receiving member and then move the applicator out of contact with the surface of the rotatable image receiving member after a predetermined distance has been traveled by the rotatable image receiving member, and move the metering blade out of contact with the surface of the rotatable image receiving member after the applicator moves out of contact with the surface of the rotatable image receiving member.

* * * * *